US008714659B2

(12) United States Patent
Klabisch et al.

(10) Patent No.: US 8,714,659 B2
(45) Date of Patent: May 6, 2014

(54) BIT ARRANGEMENT FOR A MINING PLOUGH, AND MINING PLOUGH FOR PLOUGH SYSTEMS

(75) Inventors: Adam Klabisch, Dortmund (DE); Norbert Hesse, Bochum (DE); Gerhard Siepenkort, Lunen (DE); Klaus Duhnke, Werne (DE); Diedrich Bettermann, Unna (DE)

(73) Assignee: Caterpiller Global Mining Europe GmbH, Lunen (DE)

( * ) Notice: Subject to any disclaimer, the term of this patent is extended or adjusted under 35 U.S.C. 154(b) by 251 days.

(21) Appl. No.: 13/265,105

(22) PCT Filed: Apr. 16, 2010

(86) PCT No.: PCT/IB2010/051674

§ 371 (c)(1),
(2), (4) Date: Oct. 18, 2011

(87) PCT Pub. No.: WO2010/122466

PCT Pub. Date: Oct. 28, 2010

(65) Prior Publication Data

US 2012/0043802 A1 Feb. 23, 2012

(30) Foreign Application Priority Data

Apr. 21, 2009 (DE) ..... 10 2009 003 808

(51) Int. Cl.
*E21C 27/34* (2006.01)

(52) U.S. Cl.
USPC ..... 299/34.04; 299/108

(58) Field of Classification Search
USPC ..... 299/108, 106, 34.04
See application file for complete search history.

(56) References Cited

U.S. PATENT DOCUMENTS

| | | | | |
|---|---|---|---|---|
| 3,134,581 | A | 5/1964 | Georg | |
| 3,379,476 | A | 4/1968 | Erwien et al. | |
| 3,785,703 | A | 1/1974 | Frenyo et al. | |
| 3,847,438 | A * | 11/1974 | Huttenbrauck et al. | 299/34.08 |
| 4,063,781 | A | 12/1977 | Georg et al. | |
| 4,179,161 | A * | 12/1979 | Breuer et al. | 299/34.03 |
| 4,244,625 | A * | 1/1981 | Turner et al. | 299/83.1 |
| 4,768,836 | A | 9/1988 | Nowak | |
| 6,457,268 | B1 * | 10/2002 | Perry et al. | 37/403 |

FOREIGN PATENT DOCUMENTS

| | | |
|---|---|---|
| DE | 1168845 B | 4/1964 |
| DE | 1168845 B1 | 4/1964 |
| DE | 7110531 U | 6/1971 |

(Continued)

*Primary Examiner* — John Kreck
(74) *Attorney, Agent, or Firm* — Foley & Lardner LLP

(57) ABSTRACT

A bit arrangement for fastening to a plough-body element of a mining plough for underground mining, particularly of a coal plough for the excavation of steeply disposed coal seams, having a plurality of bit pockets for accommodating, preferably demountably, respectively one bit per bit pocket. In order thereby to create a bit arrangement and a mining plough that can be used advantageously for the excavation of steeply disposed mineral deposits and that render possible economic excavation of such mineral deposits, at least two bit pockets are locked in recesses on a front side of a bit strip, which is provided, on a back side, with at least one groove indentation for the positive engagement of a locking projection on the plough-body element and is detachably fastenable to the plough-body element by means of detachable fastening means.

23 Claims, 3 Drawing Sheets

(56) References Cited

FOREIGN PATENT DOCUMENTS

| | | | |
|---|---|---|---|
| DE | 3106565 | A1 | 9/1982 |
| DE | 3447175 | A1 | 7/1986 |
| DE | 3517063 | C1 | 9/1986 |
| DE | 3923969 | A1 | 1/1991 |
| DE | 10161015 | A1 | 6/2003 |

* cited by examiner

BIT ARRANGEMENT FOR A MINING PLOUGH, AND MINING PLOUGH FOR PLOUGH SYSTEMS

The invention relates to a chisel bit arrangement for fastening to a plough-body element of a mining plough for underground mining, particularly of a coal plough for the excavation of steeply disposed coal seams, having a plurality of bit pockets for accommodating, preferably demountably, respectively one bit per bit pocket. The invention relates further to a mining plough for plough appliances for the exploitation of minerals in an inclined formation, particularly a coal plough for the excavation of steeply inclined coal seams, with a plough body, with guide means for guiding the mining plough on a guide device of the plough appliance and having bit arrangements having a plurality of bit pockets for accommodating, preferably demountably, respectively one bit per bit pocket.

BACKGROUND OF THE INVENTION

In the last two decades, the automatic mechanisation of the extraction of flatly disposed coal seams, of 0 to 20 gon (0 to 18 degrees), and of slightly inclined deposits, of gradients of 20 to 40 gon (18 to 36 degrees), has resulted in output rates of up to 1,500 t/h with the use of mining ploughs in plough appliances, and over 2,600 t/h with the use of shearer loaders. Meanwhile, more than 90% of the quantity of coal excavated underground originates from flat or slightly inclined deposits, since the latter can be excavated substantially more economically by means of the existing mining technology than can coal seams or other mineral deposits in a greatly inclined disposition, of a gradient of more than 40 gon (36 degrees), or in a steep disposition, of 60 to 100 gon (54 to 90 degrees).

A coal plough, which is provided with a bit carrier that is pivotable according to the direction of travel, and which is moved back and forth reversingly in the underground face, parallelwise in relation to the excavation front, by means of a continuous plough chain, has proved successful for the excavation of flatly disposed coal seams. Each bit carrier is provided with a multiplicity of bit pockets, in which, in turn, plough bits can be accommodated in a demountable manner. In order to achieve a different excavation height by means of the same coal plough, there is additionally provided a roof bit carrier, which is arranged centrally between the two pivotable bit carriers and which can be extended or retracted in an appropriate manner, for example by means of a worm gearing. Insofar as possible, the same bit pocket is fixed both on the pivotable bit carriers and on the roof bit carrier, in order to minimize the production costs. DE 39 23 969 C2 describes, by way of example, such a coal plough having pivotable bit carriers and roof bit carriers.

There are multiple differing possibilities for anchoring a plough bit in a bit pocket in such a way that the necessary mining work, in particular the excavation of coal or other minerals at the excavation front, can be performed reliably and with an adequate tool life by means of the plough bits. DE 101 61 015 A1 describes, merely by way of example, a bit arrangement having bit pockets and a plough bit that can be fastened in the bit pocket.

SUMMARY OF THE INVENTION

An object of the invention is hereby to create a bit arrangement and a mining plough that can be used advantageously in the case of mining ploughs, or plough appliances, particularly for the excavation of steeply disposed mineral deposits, and that render possible economic excavation of such mineral deposits, particularly coal seams.

These and further objects are achieved, in respect of the bit arrangement, in that at least two bit pockets are fixed in recesses on a front side of a bit strip, this bit strip being provided, on a back side, with at least one groove indentation for the positive engagement of a locking projection on the plough-body element and being detachably fastened to the plough-body element by means of detachable fastening means. In the case of the bit arrangement according to the invention, a plurality of bit pockets are therefore fixed on a bit strip, which constitutes an exchangeable part that, in an appropriate manner, can relatively easily be fastened to the plough-body element or detached from the latter. The groove indentation, on the back side of the bit strip, and a locking projection, on the plough-body element, that engages positively in the groove indentation ensure, together with the fastening means, that the bit strip does not get lost during the mining work and that all forces transferred into the bit pockets via the plough bits can be transferred reliably into the associated plough-body element of the mining plough.

In the case of a particularly preferred design, the bit strip has, on the back of the front side, a longer top limb and a shorter locking limb, which are offset in relation to one another in respect of height and between which the groove indentation is realized. Such a design of the bit strip enables it to be pushed onto the plough-body element with, at the same time, large-area contact between the bit strip on the one hand and the plough-body element on the other hand, whereby not only is a better supporting of the bit strip ensured, but the mounting, or demounting, until the engagement of the groove indentation and locking projection is ensured, is assisted, in that the surfaces bearing on one another constitute guide surfaces. It is particularly advantageous if the back edge of the top limb constitutes a locking projection for the purpose of positive setting into a locking indentation on the plough-body element, in order that the bit strip is positively locked on the plough-body element at two regions that are spaced apart from one another, and in order that the detachable fastening devices are not subjected to load by the large forces occurring during operational use.

The top limb can be provided, in particular, with two round feedthroughs for, respectively, one fastening means per feedthrough. Further, preferably, the front side of the bit strip can graduate, via a sloping surface, into the short limb, in order to achieve, with the sloping surface, a favorable removal of the mined-in material into a discharge channel, in particular a chute channel of the plough appliance, which sloping surface, particularly advantageously, when in the mounted state, lies flush relative to a slope or sloping surface on the front side of the plough-body element.

In the case of all designs, it is advantageous if the bit pockets are anchored in, in particular welded into, recesses that are open towards the top side of the top limb of the bit strip. The back side of the recesses can then constitute a stop, via which the forces introduced into the bit pockets are deflected first into the bit strip and then, in particular via the surrounding walls of the groove indentation, into the plough-body element. The invention offers particular advantages if the bit strips can be used multiply, in the manner of a modular principle, on a plough-body element or on differing plough-body elements. At the same time, it is advantageous if it is ensured, by means of the bit strips, that adjacently located plough bits are disposed such that their bit tips are offset relative to the direction of travel of the mining plough, in order to improve the breaking-out of the minerals and the removal of the mined-in material. Depending on the width and design of the plough-body element, at least the top limb of the bit strip can be realized in the form of a parallelogram, in order that this offset engagement of the bit tips of the individual plough bits is already achieved through the basic shape of the top limb. In order to achieve at the same time a symmetrical distribution of the individual bits over the width of the mining plough, however, the front side, in the case of an alternative, second embodiment of a bit strip, can extend in the form of a wedge or curve, and the top limb of this bit strip has the greatest depth in the center. The bit pockets can then be arranged on the front side in such a way that one bit pocket is located in the center, and the plough bit fastened in this central bit pocket is located with a forward offset in the direction of excavation relative to all other plough bits. A wedge-shaped or curved bit strip is suitable, in particular, for use in the case of use of plough-body elements of small width and/or in the center of a wide plough-body element fitted with a plurality of bit strips. In the case of all designs, it is particularly advantageous if approximately 4 to 8, in particular 4 to 6, bit pockets are arranged per bit strip.

The above objects and others can be achieved in the case of a mining plough having a divisible plough body having two plough-body basic elements, which comprise the guide means, and having at least one plough-body intermediate element that is insertable between the plough-body basic elements for the purpose of increasing the width of the plough body, or the extraction height of the mining plough, at least one bit strip being fastened or fastenable to the plough-body intermediate element by means of detachable fastening means, which bit strip has at least two recesses for the purpose of fixing at least two bit pockets on a front side of the bit strip and which, on the back side, is provided with at least one groove indentation for the positive engagement of a locking projection realized on the plough-body intermediate element.

According to an advantageous design, the plough-body intermediate element can be provided, on a front side facing in the direction of excavation, with a forwardly projecting locking strip, as a locking projection, the top surface of which extends as far as into a locking indentation realized so as to be backwardly and upwardly offset relative to the locking projection, such that the bit strip is positively anchored on the plough-body intermediate element at two regions that are spaced apart from one another. A top surface of the plough-body intermediate element can be provided with two blind cutouts, at the base of which or close to the base of which fastening screws of the fastening means can be anchored. For this purpose, each blind cutout can be provided with a threaded bore at its base, or it is preferably provided with countersinkings for the purpose of accommodating screw heads of the fastening screws. Expediently, each plough-body intermediate element also has, at a transition of its front side to the underside, a slope that acts particularly advantageously in combination with the sloping surface on the bit strip, in order to improve the removal of mined-in materials into a discharge channel in the case of the excavation of steeply disposed deposits.

The fastening means for detachably fastening the bit strip to the mining plough can have, in particular, fastening bushes, which can be formed by a cylinder without, or preferably with, an annular collar. In the case of a possible design, the annular collar, when in the mounted state, can bear on the top limb of the bit strip and be clamped against the top limb of the bit strip by means of the fastening screw, which, by means of its screw head, is anchored on the plough-body intermediate element, in particular in the blind cutout on the plough-body intermediate element. Alternatively, the annular collar, when in the mounted state, can also be spaced apart from the top limb and, for example, only accommodate in a countersunk manner the nut for tightening the fastening screw. The fastening screw then exclusively secures the fastening bush against loosening, e.g. as a result of vibrations during operational use, without the bit strip being clamped against the plough-body intermediate element by means of the fastening bush.

Further advantages and developments of the invention are given by the following description of exemplary embodiments, shown schematically in the drawings.

Further, these and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
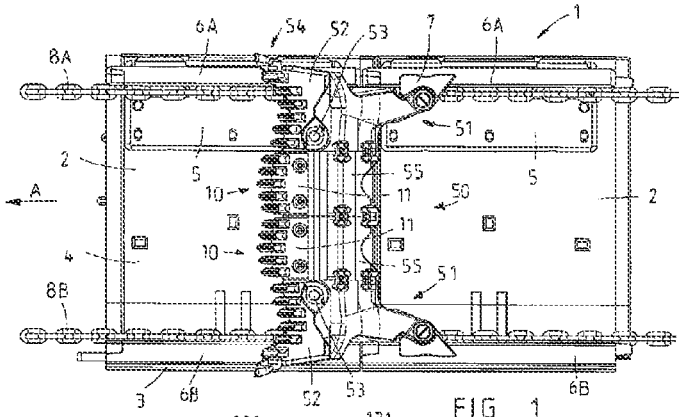
FIG. 1 shows a portion of a plough appliance for excavating steeply disposed coal seams by means of a mining plough according to the invention, including a bit arrangement, according to the invention, according to a first exemplary embodiment.

Referring now to the drawings wherein the showings are for the purpose of illustrating preferred and alternative embodiments of the invention only and not for the purpose of limiting same, in FIG. 1, reference 1 denotes in general a plough appliance for mining coal in an underground, steeply disposed coal seam of a gradient of, for example, more than 45 gon (40.5 degrees). The plough appliance 1 can be moved parallelwise in relation to the excavation front in the steeply disposed deposit, and FIG. 1 shows a top view of the plough appliance 1 from the excavation front, the tilt of the plough appliance not being represented, however, for reasons of clarity. The plough appliance 1 is composed, in known manner, of a multiplicity of trough pans 2 of mutually identical construction, which, here, are realized as preferably angular trays and which, by means of a lower limb 3, bear on the so-termed footwall that is inclined, relative to the horizontal, at an angle corresponding to the gradient, while the limb 4 aligned approximately perpendicularly thereto extends, when in operational use, parallelwise in relation to the excavation face, or excavation front. Screwed on to the limb 4 of the trough pans 2, close to its upper end, are supporting arms 5, by means of which an upper guide bar element 6A is supported, at a sufficient distance, per trough element 2, such that the upper guide bar elements 6A, arranged in alignment in relation to one another, can constitute an upper guide device for the mining plough denoted in general in FIG. 1 by the reference 50. Attached to the lower limb 3 of the trough pans 2, and opposite and parallel to the upper guide bars 6A, are lower guide bar elements 6B, as lower guide devices of the plough appliance 1, and the mining plough 50 is guided by means of a total of four pivotable slide shoes 7, of which only the rear slide shoes can be seen in FIG. 1, on the upper guide bar elements 6A, on the one hand, and on the lower guide bar elements 6B, on the other hand. The guide bar elements 6A, 6B and the mining plough 50, when in the assembled state, are at a relatively large distance from the limb 4 of the trough pans 2.

In the case of a steeply disposed coal seam, mining work is performed by means of the mining plough 50 only in the arrow direction A, for which purpose the mining plough 50 is either moved upwards, in the arrow direction A, by means of two continuous plough chains 8A, 8B attached to the mining plough 50, on to a so-termed head gate for the purpose of performing mining work, or it is moved back downwards, contrary to the arrow direction A, to a removal gate, without performing mining work during this back movement. The material mined-in during a movement of the mining plough 50 in the direction of excavation A is dropped into the tray-shaped trough. The mined-in material is caused to slide off towards the removal gate by the actually oblique position of the trough pans 2, or of the plough appliance 1. For a more detailed description of the structure of the plough appliance 1, reference is made to a protective-right application of the applicant, filed on the same date for the plough appliance and the mining plough, and the disclosure content of which is included here by mention.

Shown in the exemplary embodiment according to FIG. 1 is a mining plough 50 composed of a total of four plough-body elements, namely, two outer plough-body basic elements 51, to which the guide shoes 7 and the plough chains 8A, 8B are attached, or are fastened in a pivotally movable manner, and two plough-body intermediate elements 55, which are demountable from one another and which are each fastened to one of the plough-body basic elements 51. Each plough-body basic element is further provided, respectively, with a pivotable bit carrier 52, which, respectively, is pivotable about a pivot pin supported on the plough-body basic element 51. Each bit carrier 52 is equipped with, in this case, seven plough bits 54, and the pivoting capability of the bit carriers 52 ensures that the plough bits 54 are in active engagement with the excavation front only when the mining plough 50 is pulled in the direction of excavation A. The two plough-body intermediate elements 55 are identical to one another in their structure, and serve to increase the width, or excavation height, of the mining plough 50 in comparison with a coal plough consisting only of the two plough-body basic elements 51.

The protective-right application of the applicant submitted on the same date as the present application, and to which reference has already been made above, also relates, in particular, to the structure and the nature of the connection of the plough-body basic elements 51 to one or more plough-body intermediate elements 55, and reference is made to this protective-right application for the purpose of complementing the disclosure. The invention relates, in particular, to the design and the structure of bit arrangements 10, with which the plough-body intermediate elements 55 are provided. In FIG. 1, each plough-body intermediate element is equipped with a single bit strip 11, according to a first embodiment. Before the structure of this bit strip 11 is described, however, reference is first made to FIGS. 2 and 3, which show an alternative, second exemplary embodiment of a mining plough 150 having a plurality of bit arrangements, or bit strips, on the plough-body intermediate element 155.

Figure 2:
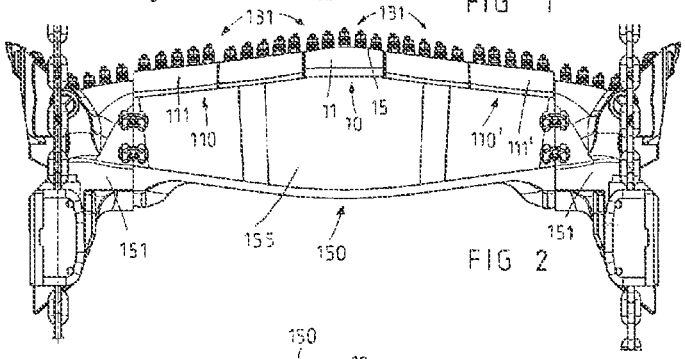
FIG. 2 shows a second exemplary embodiment of a mining plough having a bit arrangement according to the invention.
Figure 3:
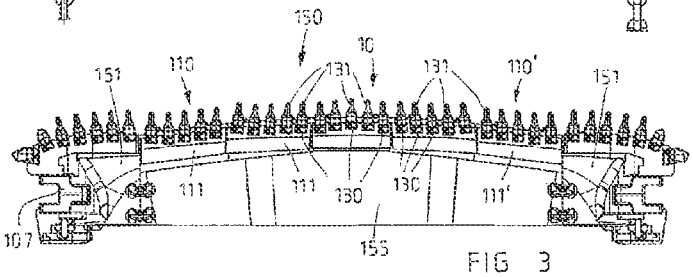
FIG. 3 shows the mining plough from FIG. 2 as viewed from the front.

As clearly evident from a comparison with FIG. 1, the mining plough 150 shown in FIGS. 2 and 3 has a significantly greater width than the mining plough of FIG. 1, although only a single plough-body intermediate element 155 is inserted between the two plough-body basic elements 151. In the case of the mining plough 150, however, the plough-body intermediate element 155 consists of a wide, single-piece body, on which three differing designs of bit arrangement 110, 110' and 10 are arranged. The plough-body intermediate element 155 is detachably connected, respectively, to an outer plough-body basic element 151, fastened to which, respectively, so as to be pivotally movable, are two slide shoes 107 for the purpose of guiding the mining plough on the coal plough appliance. An aspect according to the invention consists in the bit arrangements 10, 110 and 110' being realized as detachable wearing parts that allow both rapid exchange and multiple use. For this purpose, each bit arrangement 10, 110 and 110' according to the invention has a bit strip 11, 111 and 111', respectively, and five bit pockets 130 are anchored, respectively, on each bit strip 11, 111 and 111'. In turn, a plough bit 131 is inserted in each bit pocket 130.

Reference is now made to FIGS. 4 to 9, in which the bit arrangement 110, having a bit strip 111 that in this case is realized with a base area approximately in the form of a parallelogram, is shown exemplarily in detail. In particular, FIGS. 5 to 7 and FIG. 9 make clear that each bit strip 111 has a cross-section that is substantially constant over the width, and comprises a longer, thicker top limb 112, as well as a shorter locking limb 113 beneath the top limb 112. A backwardly open groove indentation 114, in which there engages positively the locking projection 156, shown in FIG. 5, on the front side 157 of the plough-body intermediate element 155, is realized between the top limb 112 and the locking limb 113, which are connected via a thick base that constitutes the front side 115. The front side 115 of the bit strip 111 graduates into the shorter locking limb 113 via a sloping surface 116. The top limb 112 is provided, at the back edge 117, with an offset, enabling the top limb 112, via its back edge 117, to constitute a locking projection, which, again shown by FIG. 5, in the mounted position is set positively into a locking indentation 158 in the plough-body intermediate element 155. In the mounted position, therefore, each bit strip 111 is positively connected to the plough-body intermediate element 155 via two tongue-and-groove connections extending substantially parallelwise in relation to the front side 115.

Each bit strip 111 is provided with, in this case, respectively five recesses 160 that are open forwardly, towards the front side 115, and upwardly, towards the top surface 112' of the top limb 112. In all exemplary embodiments, each bit strip 112 has respectively five recesses 160 realized so as to be identical to one another, and a bit pocket 130, in which a plough bit 131 is demountably inserted in a manner known per se, is fixed, in particular welded into, each recess 160. In a preferred design, in this case the same bit pockets 130 and preferably the same plough bits 131 are used both on the bit strips 11 (FIGS. 1 to 3) of the bit arrangements 10 and on the bit strips 111 of the bit arrangements 110, 110'.

Reference is now made again to FIGS. 1 to 3. Bit arrangements 10, each consisting of a single bit strip 11, are fastened to the plough-body intermediate elements 55 of the mining plough in FIG. 1. A bit arrangement 10 of like structure, comprising a bit strip 11, is also mounted centrally on the plough-body intermediate element 155, between the bit strips 111, in the form of a parallelogram, attached on the left of this bit strip 11, and the bit strips 111' attached on the right. The bit arrangements 110 and 110' differ, basically, only in the angular position of the parallelogram and in the possibility of application, to that extent defined, on the left or right, respectively, on the plough-body intermediate element 155, all bit strips 11, 111, 111' being in each case fastened positively to the plough-body intermediate elements 55 or 155 in an identical manner and by means of the same fastening means 70. The structure and fastening of the bit strips by means of the fastening means 70 is now to be explained.

Figure 4:
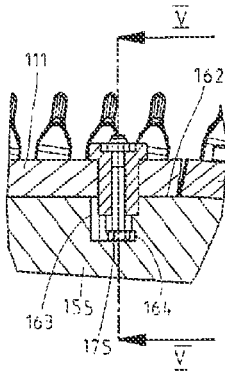
FIG. 4 shows a partially opened-up sectional view through a fastening means for fastening a bit strip to a plough-body element.
Figure 5:
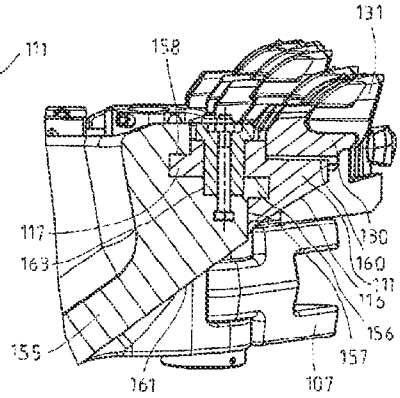
FIG. 5 shows a sectional view along V-V in FIG. 4.
Figure 6:
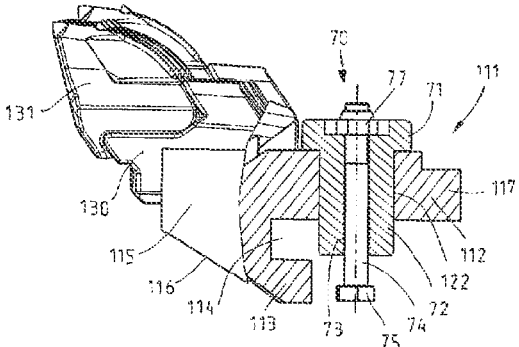
FIG. 6 shows a partially opened-up side view of a bit strip according to the invention.
Figure 7:
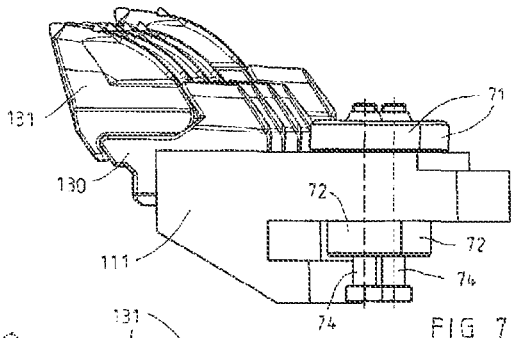
FIG. 7 shows a side view of the bit strip from FIG. 6.
Figure 8:
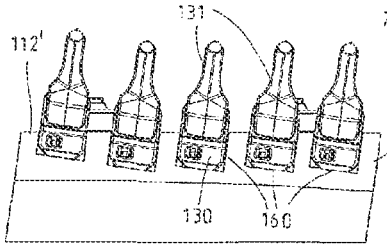
FIG. 8 shows the bit strip from FIG. 7, as viewed from the left.
Figure 9:
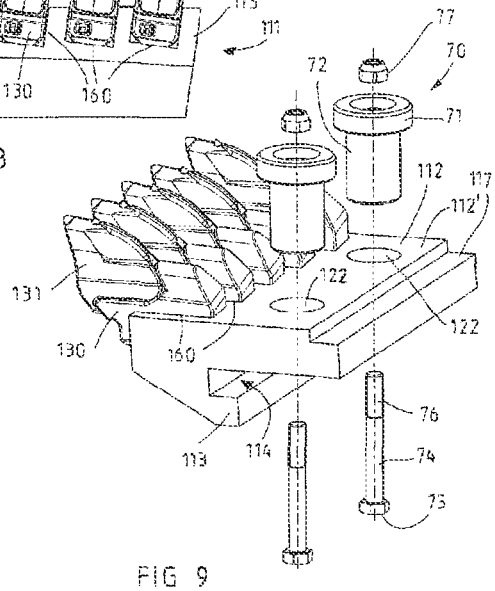
FIG. 9 shows a perspective view of the bit strip from FIGS. 6 to 8, with the fastening means shown in an exploded representation.

Each top limb 112 of the bit strips 111 has two circular feedthroughs 122, into which fastening bushes 72, here provided with an annular collar 71, can be inserted from above. Each fastening bush 72 has a central, stepped through-bore 73 for the feeding-through of a fastening screw 74 and for the countersunk receiving of a fastening nut 77. Each fastening screw 74, in turn, has a screw head 75, and has a threaded portion 76, on to which the fastening nut 77 can be screwed from above when the bit strip 111 is in the mounted position on the plough-body intermediate element 155 and, accordingly, the groove indentation 114 and the locking projection 156, or the locking indentation 158 and the back edge 117 of the top limb 112, engage positively in one another. This positive mutual engagement in two regions, over relatively long surfaces in each case, can be sufficient to divert into the body of the plough-body intermediate elements all forces exerted upon the plough bits when in operational use, and it remains only for the fastening bushes to secure this position if necessary. Then, when fastening bush 72 is clamped against the body of the plough-body intermediate element by means of the fastening screw 74, the annular collar could have a small air gap in relation to the top limb. Alternatively, the annular collar 71 could press, by means of its lower annular flange, against the top surface 112 and, through tightening of the fastening nut 77, this mounting position can be additionally secured against loosening. In order to anchor the screw head 75 of the fastening screws 74 on the plough-body intermediate element 155, a top surface 162 is provided, extending above the locking projection 156 and having respectively one blind hole 163 per fastening device 70, and a milled-out groove 164, into which the screw head 75 can be inserted, preferably so as to be secure against rotation, as shown, in particular, by FIGS. 4 and 5, is provided close to the base of the blind hole 163. In order to demount the bit strips 111, it is necessary either first to remove the fastening bushes 72, or the entire bit strip 111 is moved transversely relative to the direction of movement, or direction of excavation, of the mining plough, with the nuts 77 having been loosened but with the fastening bushes 72 still mounted, until the screw heads 75 are released from the milled-out grooves, in order then, after removal of the fastening bushes 72 and the fastening screws 74, for the bit strips to be drawn out forwards, as a result of which the positive engagement of the groove indentation 114 and the locking projection 156, or of the back edge 117 and the locking indentation 158, is only then released. In the mounted state, the slope 116 on the front side 115 of the bit strip 11 lies in approximately flush alignment relative to a sloping surface 161 via which the front side 157 of the plough-body intermediate element 155 graduates into an underside.

Whereas the bit strips 111 and 111' can be multiply attached to the same plough-body intermediate element 155, the bit strip 11 is suitable for attachment both to the plough-body intermediate elements 55 and to the plough-body intermediate element 155. The bit strip 11 is not realized in the form of a parallelogram, but has a front side 15 extending in the form of a curved arc, as shown particularly clearly by FIG. 2, for which reason the middle plough bit of the five plough bits 131 fastened to the bit strip 11 projects further forwards in the direction of excavation than the plough bits 131, fastened adjacently to this middle plough bit, on the same bit strip 11. Consequently, in the case of the mining plough 50, an approximately W-shaped profile of the bit tips of all plough bits 131 and 54 can be achieved.

For the specialist, the preceding description gives rise to numerous modifications, which are intended to come within the protective scope of the appended claims. The figures show only two exemplary embodiments of a mining plough. It is understood that the intermediate body shown in FIG. 1 could be applied as only one intermediate body or, also, as more than two intermediate bodies, between the plough-body basic elements. It would also be possible to use other, differently designed plough-body intermediate elements, to which more or fewer bit strips are attached. The number of bit pockets and plough bits per bit strip can vary between three and eight, in particular between four and six. The plough bits are preferably detachably fastened in the associated bit pockets. Since the bit strips can be demounted from the plough body, however, fixed anchoring of the plough bits in the bit pockets would also be possible.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A bit arrangement for fastening to a plough-body element of a mining plough for underground mining, particularly of a coal plough for the exploitation of steeply inclined coal seams, the bit arrangement comprising a plurality of bit pockets for accommodating one bit per each bit pocket, at least two bit pockets are fixed in recesses on a front side of a bit strip, which is provided, on a back side, with at least one groove indentation for the positive engagement of a locking projection on an associated plough-body element and is detachably fastenable to the associated plough-body element by a detachable fastening means.

2. The bit arrangement according to claim 1, wherein the bit strip has, on the back of the front side, a longer top limb and a shorter locking limb, between which the groove indentation is realized.

3. The bit arrangement according to claim 2, wherein a back edge of the top limb constitutes a locking projection for the purpose of positive setting into a locking indentation on the associated plough-body element.

4. The bit arrangement according to claim 2, wherein the top limb is provided with two round feedthroughs for, respectively, one of the fastening means per feedthrough.

5. The bit arrangement according to claim 2, wherein the front side of the bit strip graduates, via a sloping surface, into the shorter limb.

6. The bit arrangement according to claim 2, wherein the bit pockets are anchored in recesses that are open towards a top side of the top limb.

7. The bit arrangement according to claim 2, wherein at least the top limb of the bit strip is realized in the form of a parallelogram.

8. The bit arrangement according to claim 2, wherein the front side of the bit strip extends in the form of at least one of a wedge and a curve, and the top limb has the greatest depth in the center of the bit strip, the bit pockets being arranged on the front side in such a way that one bit pocket is arranged in the center.

9. The bit arrangement according to claim 1, wherein four to six bit pockets are provided per bit strip.

10. The bit arrangement according to claim 2, wherein the fastening means have fastening bushes that are provided with an annular collar, which, when in the mounted state, bears on the top limb and is clampable against the top limb of the bit strip by a fastening screw.

11. The bit arrangement according to claim 2, wherein the fastening means have fastening bushes that are provided with an annular collar, which, when in the mounted state is spaced apart from the top limb by an air gap.

12. A mining plough for plough appliances for the exploitation of minerals in an inclined formation, particularly for the excavation of steeply inclined coal seams, the mining plough comprising a plough body, with a guide for guiding the mining plough on an associated guide device of an associated plough appliance and with bit arrangements having a plurality of bit pockets for accommodating one bit per each bit pocket, the mining plough further comprising a separable plough body having two plough-body basic elements, at least one plough-body intermediate element that is insertable between the plough-body basic elements for the purpose of increasing the width of the plough body, and at least one bit strip being detachably fastened to the plough-body intermediate element by a removable fastener inserted substantially through the bit strip, the bit strip is provided, on a front side, with at least two recesses for the purpose of fixing at least two bit pockets on the bit strip and, on the back side, is provided with at least one backwardly open groove indentation wherein the groove indentation is positively engaged with a locking projection realized on the plough-body intermediate element when the bit strip is detachably fastened to the plough-body intermediate element.

13. The mining plough according to claim 12, wherein a plurality of bit strips, each having four to eight bit pockets, are fixed on the plough-body intermediate element.

14. The mining plough according to claim 12, wherein the plough-body intermediate element is provided, on a front side facing in the direction of excavation, with a forwardly projecting locking strip, as a locking projection, the top surface of which extends as into a locking indentation.

15. The mining plough according to claim 14, wherein the top surface is provided with two blind cutouts, at the base of which fastening screws of a fastening means are anchorable.

16. The mining plough according to claim 15, wherein the blind cutouts are provided with at least one of threaded bores and countersinkings for the purpose of accommodating screw heads of the fastening screws.

17. The mining plough according to claim 14, wherein the plough-body intermediate element is provided with a slope at the transition of the front side to an underside of the intermediate element.

18. The mining plough according to claim 12, wherein the bit strip has, on the back of the front side, a longer top limb and a shorter locking limb, between which the groove indentation is realized.

19. The mining plough according to claim 18, wherein a back edge of the top limb constitutes a locking projection for the purpose of positive setting into a locking indentation on the plough-body element.

20. The mining plough according to claim 12, wherein the front side of the bit strip extends in the form of at least one of a wedge and a curve, and the top limb has the greatest depth in the center of the bit strip, the bit pockets being arranged on the front side in such a way that one bit pocket is arranged in the center.

21. The mining plough according to claim 12, wherein the bit strip is detachably fastenable to the plough-body element by a detachable fastening means, the fastening means having fastening bushes that are provided with an annular collar, which, when in the mounted state, bears on the top limb and are clampable against the top limb of the bit strip by a fastening screw.

22. The mining plough according to claim 12, wherein the bit strip is detachably fastenable to the plough-body element by a detachable fastening means, the fastening means having fastening bushes that are provided with an annular collar, which, when in the mounted state is spaced apart from the top limb by an air gap.

23. A mining plough for plough appliances for the exploitation of minerals in an inclined formation, particularly for the excavation of steeply inclined coal seams, the mining plough comprising a plough body, with a guide for guiding the mining plough on an associated guide device of an associated plough appliance and with bit arrangements having a plurality of bit pockets for accommodating one bit per each bit pocket, the mining plough further comprising a separable plough body having two plough-body basic elements, at least one plough-body intermediate element that is insertable between the plough-body basic elements for the purpose of increasing the width of the plough body, and at least one bit strip being fastened or fastenable to the plough-body intermediate element, the bit strip is provided, on a front side, with at least two recesses for the purpose of fixing at least two bit pockets on the bit strip and, on the back side, is provided with at least one groove indentation for the positive engagement of a locking projection realized on the plough-body intermediate element, wherein the bit strip is detachably fastenable to the plough-body element by a detachable fastening means, the fastening means having fastening bushes that are provided with an annular collar, which, when in the mounted state is spaced apart from the top limb by an air gap.

* * * * *

UNITED STATES PATENT AND TRADEMARK OFFICE

CERTIFICATE OF CORRECTION

PATENT NO. : 8,714,659 B2
APPLICATION NO. : 13/265105
DATED : May 6, 2014
INVENTOR(S) : Klabisch et al.

It is certified that error appears in the above-identified patent and that said Letters Patent is hereby corrected as shown below:

Title Page, Column 1, Item No. 75 (Assignee), line 1, delete "Caterpiller" and insert -- Caterpillar --.

In the Specification

Column 5, line 44, delete "element" and insert -- element 51 --.

Column 5, line 46, delete "pin" and insert -- pin 53 --.

Column 6, line 67, delete "plough" and insert -- plough 50 --.

Signed and Sealed this
Fifteenth Day of September, 2015

Michelle K. Lee

Michelle K. Lee
*Director of the United States Patent and Trademark Office*